US009033730B2

(12) United States Patent
Lu

(10) Patent No.: US 9,033,730 B2
(45) Date of Patent: May 19, 2015

(54) COAXIAL CABLE CONNECTOR AND METHOD OF MAKING SAME

(71) Applicant: Yueh-Chiung Lu, Taoyuan (TW)

(72) Inventor: Yueh-Chiung Lu, Taoyuan (TW)

(73) Assignee: Yueh-Chiung Lu, Tao-Yuan (TW)

( * ) Notice: Subject to any disclaimer, the term of this patent is extended or adjusted under 35 U.S.C. 154(b) by 23 days.

(21) Appl. No.: 13/871,551

(22) Filed: Apr. 26, 2013

(65) Prior Publication Data

US 2014/0162493 A1 Jun. 12, 2014

(30) Foreign Application Priority Data

Dec. 7, 2012 (TW) ..... 101223741 U

(51) Int. Cl.
*H01R 13/648* (2006.01)
*H01R 43/26* (2006.01)
*H01R 24/38* (2011.01)

(52) U.S. Cl.
CPC ..... *H01R 43/26* (2013.01); *Y10T 29/49208* (2015.01); *H01R 13/648* (2013.01); *H01R 24/38* (2013.01)

(58) Field of Classification Search
USPC ..... 439/322, 584, 583, 277, 792, 578
See application file for complete search history.

(56) References Cited

U.S. PATENT DOCUMENTS

| | | | | |
|---|---|---|---|---|
| 8,313,353 | B2 * | 11/2012 | Purdy et al. | 439/792 |
| 8,573,996 | B2 * | 11/2013 | Amidon et al. | 439/322 |
| 8,801,448 | B2 * | 8/2014 | Purdy et al. | 439/322 |
| 8,808,019 | B2 * | 8/2014 | Paglia et al. | 439/322 |
| 2008/0102696 | A1 * | 5/2008 | Montena | 439/578 |
| 2011/0143567 | A1 * | 6/2011 | Purdy et al. | 439/277 |
| 2012/0225581 | A1 * | 9/2012 | Amidon et al. | 439/584 |

* cited by examiner

*Primary Examiner* — Alexander Gilman
(74) *Attorney, Agent, or Firm* — Bruce Stone LLP; Joseph A. Bruce

(57) ABSTRACT

A coaxial cable connector is provided, the connector includes: a connector body, a coupling member, a post having an post collar having a forward facing surface, a conductive grounding member operationally positioned axially forward of said forward facing surface of said post collar; whereby the coupling member, grounding member and post provide at least one grounding pathway.

15 Claims, 7 Drawing Sheets

COAXIAL CABLE CONNECTOR AND METHOD OF MAKING SAME

This application claims the priority benefit of Taiwan patent application number 101223741 filed on Dec. 7, 2012, which is hereby incorporated by reference.

TECHNICAL FIELD

The present disclosure relates generally to the field of electrical connectors, and more particularly to the field of coaxial cable connectors.

BACKGROUND

A coaxial cable is a type of cable that is capable of transmitting an electrical signal. The coaxial cable may have an inner conducting wire that is separated from a tubular conductive shield by a tubular insulating layer. The core conducting wire may be a solid or braided wire formed from a metal such as copper. The conductive shield may be a foil layer or a braid of conducting metal, such as copper or aluminum. The conductive shield may be grounded to minimize interference. The insulating layer may be a dielectric that surrounds the core conducting wire and is surrounded by the conductive shield. The electromagnetic wave may exist within the insulating layer, and therefore the cable's characteristics, such as impedance, can be significantly affected by the characteristics of the insulator. The coaxial cable may have a protective sheath covering the conductive shield to further minimize interference and provide durability to the cable.

Coaxial cables are used extensively throughout modern communication networks. There are several coaxial cable connectors commonly used to facilitate connection of coaxial cables to each other and to various electronic equipment. Due to the wide variety of industrial and consumer applications for use of coaxial cables, it is important for a coaxial cable connector to maintain an accurate, durable, and reliable connection each and every time regardless of whether the coaxial cable connector is installed professionally or by a layperson.

As shown in FIG. 1-2, a coaxial cable connector 91 is typically adapted for connecting a coaxial cable 90 to a mating device 92. As shown in FIG. 2, the mating device 92 comprises an F-connector 95 having external thread 96, a contact face 903 and a conductive clamp 98 disposed on the inside. As shown in FIG. 1-2, typically the coaxial cable connector 91 creates a grounding path by tightly fastening the internal thread 94 of the coupling member 93 with the external thread 96 of the F-connector 95 of the mating device 92, such that the contact face 903 of the F-connector 95 applies pressure on a forward end face 902 of the post 99 to keep positive contact between post 99, coupling member 93, and F-connector 95. Typically this configuration creates a grounding path between the mating device 92 (as shown in FIG. 2) and a conductive shield 901 of the coaxial cable 90 (as shown in FIG. 1) thereby providing improved signal performance of a core conducting wire 97.

For various reasons, such as movement of the equipment, vibrations, or improper installation of the connector, when operationally installed, the connection between the coaxial cable connector 91 (as shown in FIG. 1) and the mating device 92 (as shown in FIG. 2) may become loose. This may result in a poor signal quality and RFI leakage due to the weak connection between the conductors of the mating device 92 and the coaxial cable 90. Therefore, a need exists for a coaxial cable connector that is configured to maintain proper connection performance between those conductors even in the event that the coaxial cable connector becomes loose or is improperly installed.

Typically, coaxial cable connectors have a connector body 10 comprising a conductive material such as steel or copper to create part of the grounding pathway as shown in FIG. 3. The use of only conductive materials in the connector body limits possible useful designs, limits use of new materials, limits applications in which the coaxial cable connector can be used, increases manufacturing costs, and increases the weight of the coaxial cable connector. Therefore, a need exists for a coaxial cable connector that is configured to provide at least one grounding pathway while allowing for the use of a connector body that comprises conductive and/or non-conductive materials or a combination of conductive and non-conductive materials.

Typically, coaxial cable connectors have a grounding member that is disposed on the outside of the connector such that the grounding member is exposed to the elements or contaminants such as moisture, corrosive agents, and/or dust, thereby effecting both the performance and longevity of the cable connector. Other variations of coaxial cable connectors dispose the grounding member between an O-ring and a coupling member to protect the grounding member from contamination. Therefore, a need exists for a coaxial cable connector that is configured to protect the grounding member from contamination or exposure to the elements or corrosion, or the failure or improper installation of a protective element such as an O-ring.

The instant invention addresses above-mentioned deficiencies and provides numerous other advantages.

SUMMARY

The present invention is directed to an improved coaxial cable connector and method of making same that substantially obviates one or more of the limitations of the related art. To achieve these and other advantages and in accordance with the purpose of the invention, as embodied and broadly described herein, the present invention includes a coaxial cable connector comprising a connector body, coupling member, a post, a grounding member, a fastener member, a bushing, a tubular clamping body, and an O-ring.

The connector body has a first and second end. The first end of the connector is configured to receive the prepared end of a cable. The coupling member has a first and second end, the first end of said coupling member located near or proximate to the second end of the connector body. The second end of the coupling member is configured to interface with a mating device. The post has a forward and rearward end. The forward end of the post located near the coupling member when operationally installed and the rearward end configured to contact at least a portion of the conductive shield of the cable when the cable is operationally attached to the connector. The post has a post collar proximate the forward end of the post. The post collar has a forward facing surface and a rearward facing surface. The grounding member is conductive and is operationally installed forward of the forward facing surface of the post collar. Together, the grounding member, coupling member, and post create at least one grounding path. The coupling member may have an internal lip having a forward facing surface. When operationally installed, the forward facing surface of the coupling member may contact the rearward facing surface of the post, thereby providing another grounding path. The forward facing surface and rearward facing surface of the post collar may define an annular surface that may contact the internal surface of the coupling member defined between the forward facing surface of the internal lip of the coupling member and the second end of coupling member, thereby providing yet another grounding path. Furthermore, the grounding member may have resilient characteristics and/or post contact portions that facilitate contact of the grounding member with the coupling member and post. The grounding member may be operationally installed by coupling the coupling member to the mating device or by pressing the grounding member onto the post.

These and other advantages and features of the present invention will be fully understood by reference to the following specification in conjunction with the accompanying drawings, in which like reference signs denote like components of structure.

BRIEF DESCRIPTION OF THE DRAWINGS

The present disclosure may be better understood with reference to the following drawings. Matching reference numerals designate corresponding parts throughout the Figures, and components in the drawings are not necessarily to scale.

DETAILED DESCRIPTION

Figure 1:
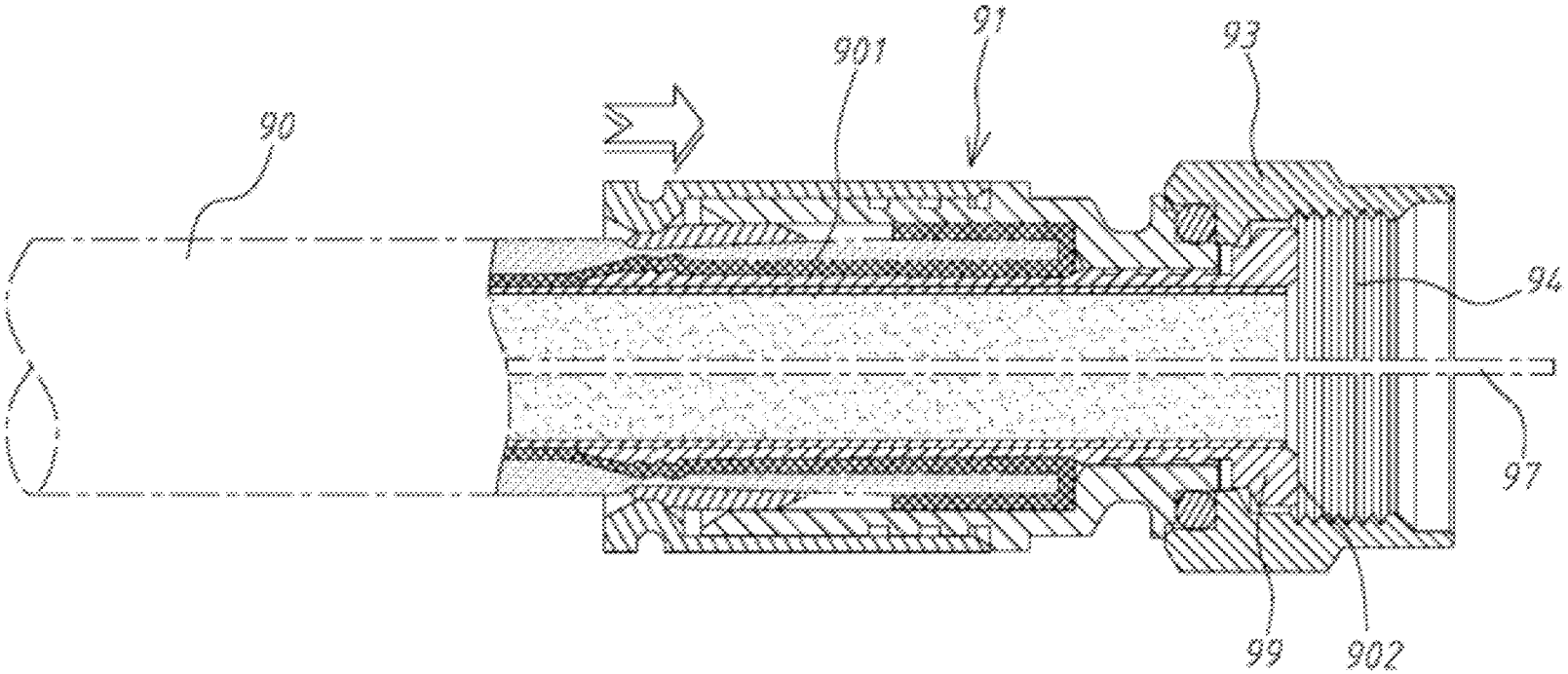
FIG. 1 (Prior Art)
FIG. 1 is a sectional view of a conventional coaxial cable connector, wherein a coaxial cable is attached to the connector.

Although certain embodiments of the present invention are shown and described in detail, it should be understood that various changes and modifications may be made without departing from the scope of the appended claims. The scope of the present invention will in no way be limited to the number of constituting components, the materials thereof, the size thereof, the shapes thereof, the relative arrangement thereof, etc., which are disclosed simply as an example of embodiments of the present invention. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring to FIG. 1, one embodiment of a coaxial cable connector 91 may be operably affixed, or otherwise functionally attached, to a coaxial cable 90 having an outer protective sheath (unnumbered), a conductive shield 901, an interior dielectric (unnumbered) and a core conducting wire 97. As is commonly known in the art, the coaxial cable 90 may be prepared by removing the outer protective sheath (unnumbered) and drawing back the conductive shield 901 to expose a portion of the interior dielectric (unnumbered). Further preparation of said coaxial cable 90 may include stripping the dielectric (unnumbered) to expose a portion of the core conducting wire 97. The outer protective sheath (unnumbered) is intended to protect the various components of the coaxial cable 90 from damage which may result from a variety of factors including exposure to dirt, dust, moisture, or corrosion, or damage during installation, handling or use. The conductive shield 901 may be comprised of conductive materials suitable for providing an electrical grounding pathway, such as copper or aluminum or other materials having conductive properties. The conductive shield 901 may be comprised of braided, foils, or like structures. Various embodiments of the conductive shield 901 may be utilized to isolate the core conducting wire 97 from the environment. For instance, the conductive shield 901 may comprise a metal foil wrapped around the dielectric (unnumbered), or several conductive strands formed in a continuous braid around the dielectric (unnumbered). Combinations of foil and/or braided strands may be utilized wherein the conductive shield 901 may comprise a foil layer, then a braided layer, and then a foil layer. It is widely know in the arts, that various layer combinations may be implemented in order for the conductive shield 901 to effectuate an electromagnetic buffer to reduce the ingress or egress of electromagnetic radiation that may disrupt broadband communications. The dielectric (unnumbered) may be comprised of materials suitable for electrical insulation, such as plastic foam material, paper materials, rubber-like polymers, or other functional insulating materials. It should be noted that the various materials of which all the various components of the coaxial cable 90 are comprised should have some degree of elasticity allowing the coaxial cable 90 to flex or bend in accordance with traditional broadband communication standards, installation methods and/or equipment. It should further be recognized that the radial thickness of the coaxial cable 90, outer protective sheath (unnumbered), conductive shield 901, interior dielectric (unnumbered) and/or core conducting wire 97 may vary based upon generally recognized parameters corresponding to broadband communication standards and/or equipment.

Figure 2:
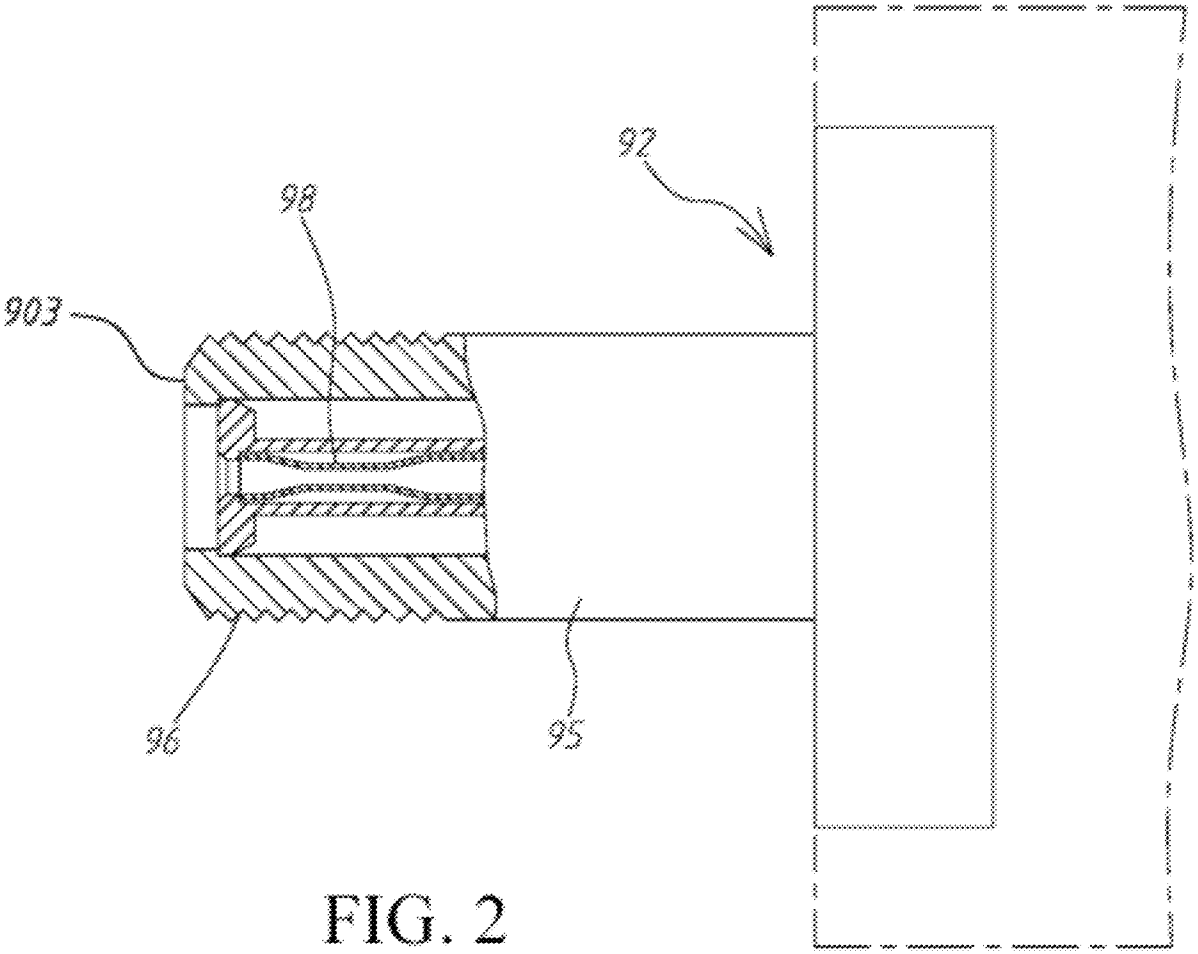
FIG. 2 (Prior Art)
FIG. 2 is a is a sectional view of a conventional mating device for use with the coaxial cable connector.

Referring to FIG. 2, an embodiment of the coaxial cable connector 91 may also include a mating device 92. The mating device 92 includes a F-connector 95 having a conductive receptacle or conductive clamp 98 for receiving a portion of the core conducting wire 97 (as operationally shown in exemplary fashion FIG. 7) sufficient to make adequate electrical contact. The mating device 92 may further comprise an external thread 96. It should be recognized that the radial thickness and/or the length of the mating device 92 and/or the F-connector 95 may vary based upon generally recognized parameters corresponding to broadband communication standards and/or equipment. Moreover, the pitch and height of threads which may be formed upon the external thread 96 of the F-connector 95 may also vary based upon generally recognized parameters corresponding to broadband communication standards and/or equipment. Furthermore, it should be noted that the mating device 92 and/or the F-connector 95 may be formed of a single conductive material, multiple conductive materials, or may be configured with both conductive and non-conductive materials corresponding to the mating device 92 and/or the F-connector 95 operable electrical interface with a coaxial cable connector 91. However, the receptacle of the mating device 92 and/or the F-connector 95 should be formed of a conductive material, such as steel, brass, copper, aluminum, or other suitable conductive material. Further still, it will be understood by those of ordinary skill that the mating device 92 and/or the F-connector 95 may be embodied by a connective interface component of a coaxial cable communications device, a television, a router, a computer port, a network receiver, or other communications devices such as a signal splitter, a cable line extender, a cable network module and/or the like.

Figure 3:
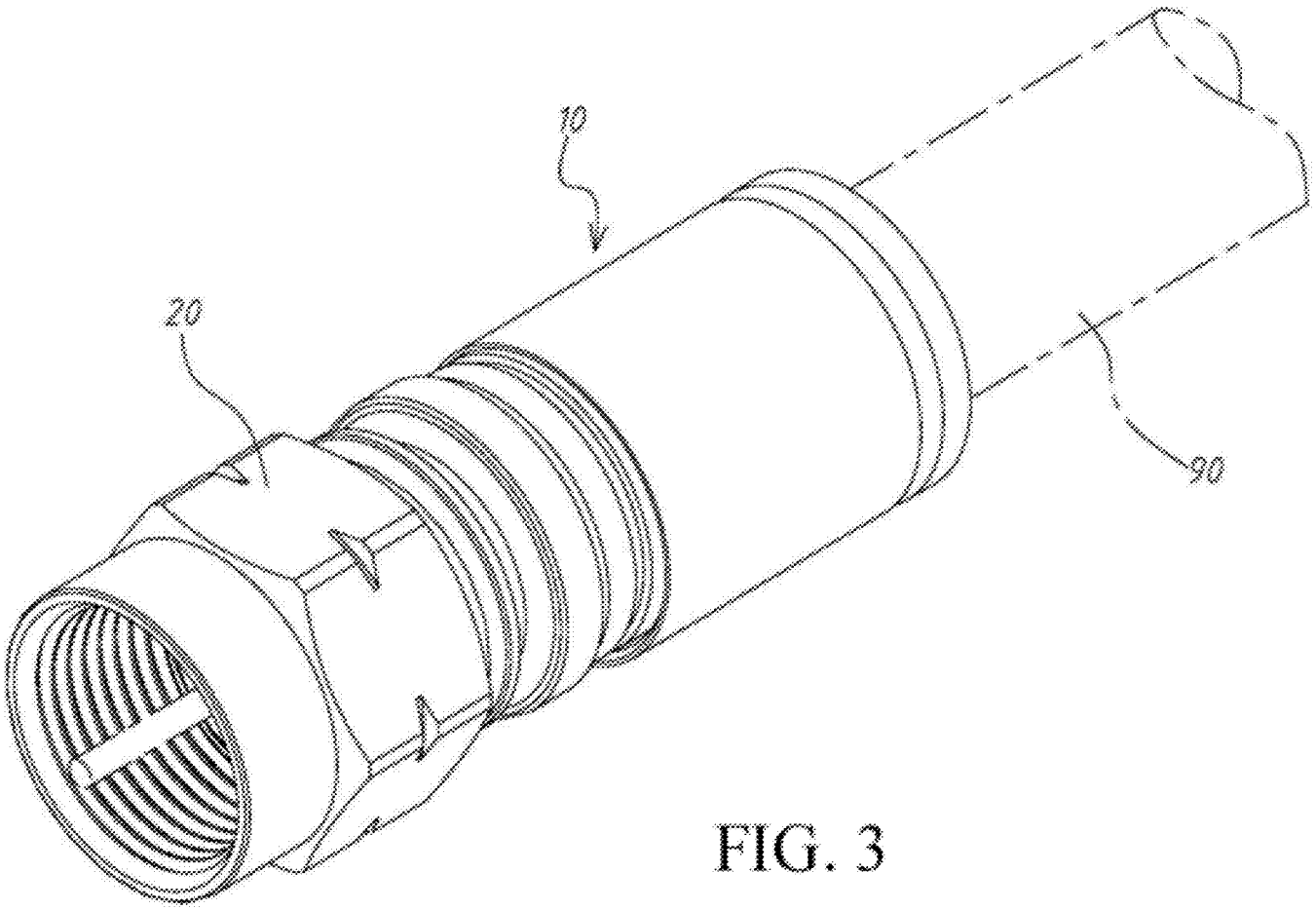
FIG. 3 depicts a perspective view of an embodiment of the coaxial cable connector, wherein a coaxial cable is attached to the connector.

Referring to FIG. 3, an embodiment of the coaxial cable connector 91 may include a first end and second end. Said first end including a connector body 10 capable of receiving the prepared end of the coaxial cable 90. Said second end may include a coupling member 20.

Figures 4, 4A:
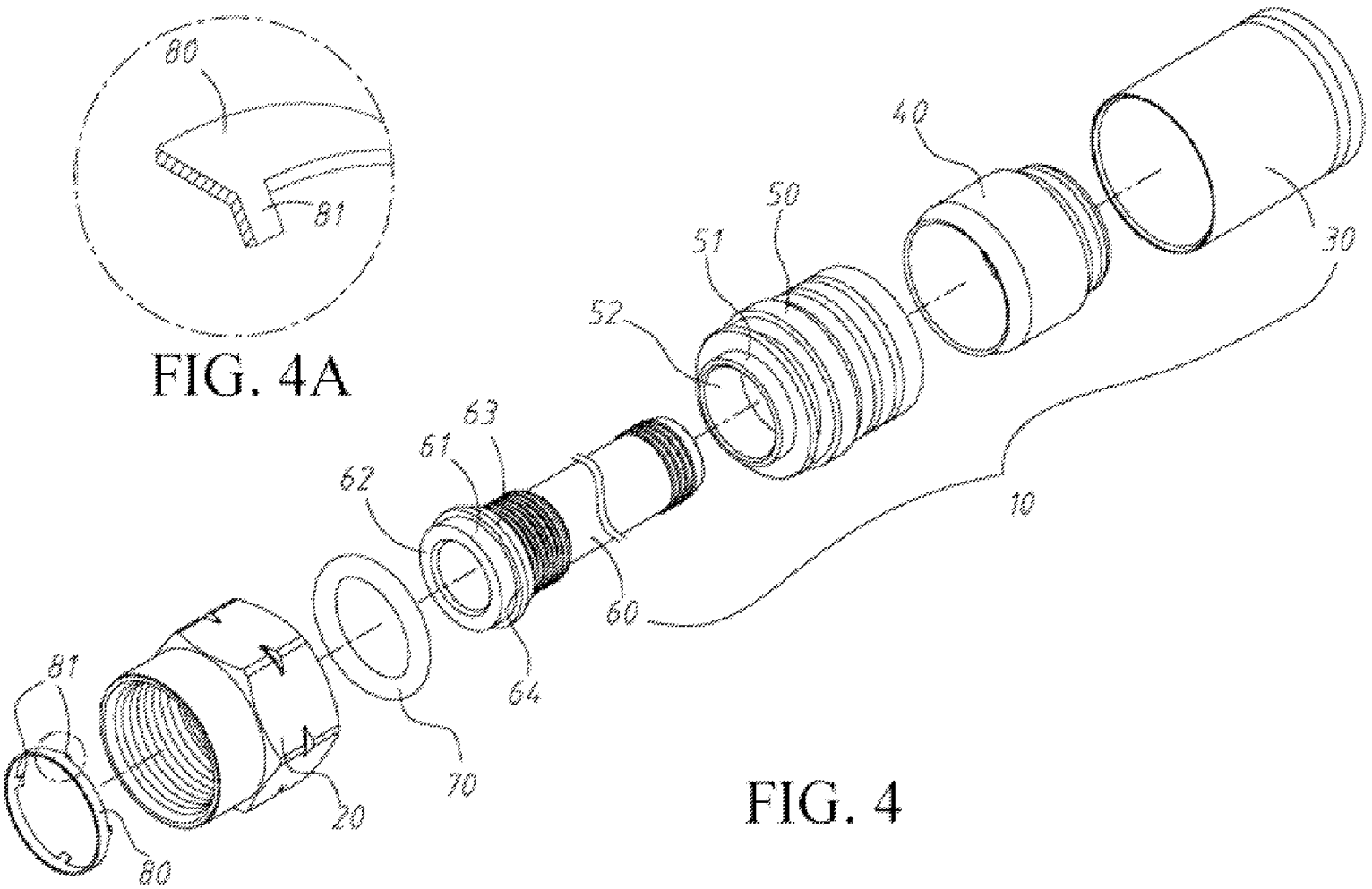
FIG. 4 depicts an exploded perspective cut-away view of the embodiment of the coaxial cable connector.
FIG. 4A is an enlarged view of the an embodiment of the grounding member of the coaxial cable connector of FIG. 4, in accordance with the present invention.

Referring to FIG. 4, an embodiment of the coaxial cable connector 91 may include a coupling member 20, a post 60, the connector body 10, a sealing member or O-ring 70 configured to fit around a portion of the connector body 10, and a grounding member 80. The coupling member 20 of embodiments of a coaxial cable connector 91 has a forward end having internal threading and opposing rearward end configured to engage the connector body 10. The coupling member 20 may comprise internal threading extending axially from the edge of forward end a distance sufficient to provide operably effective threadable contact with the external threads 96 of a mating device 92 or F-connector 95 (as shown, by way of example in FIGS. 2-5 and 7).

Figure 5:
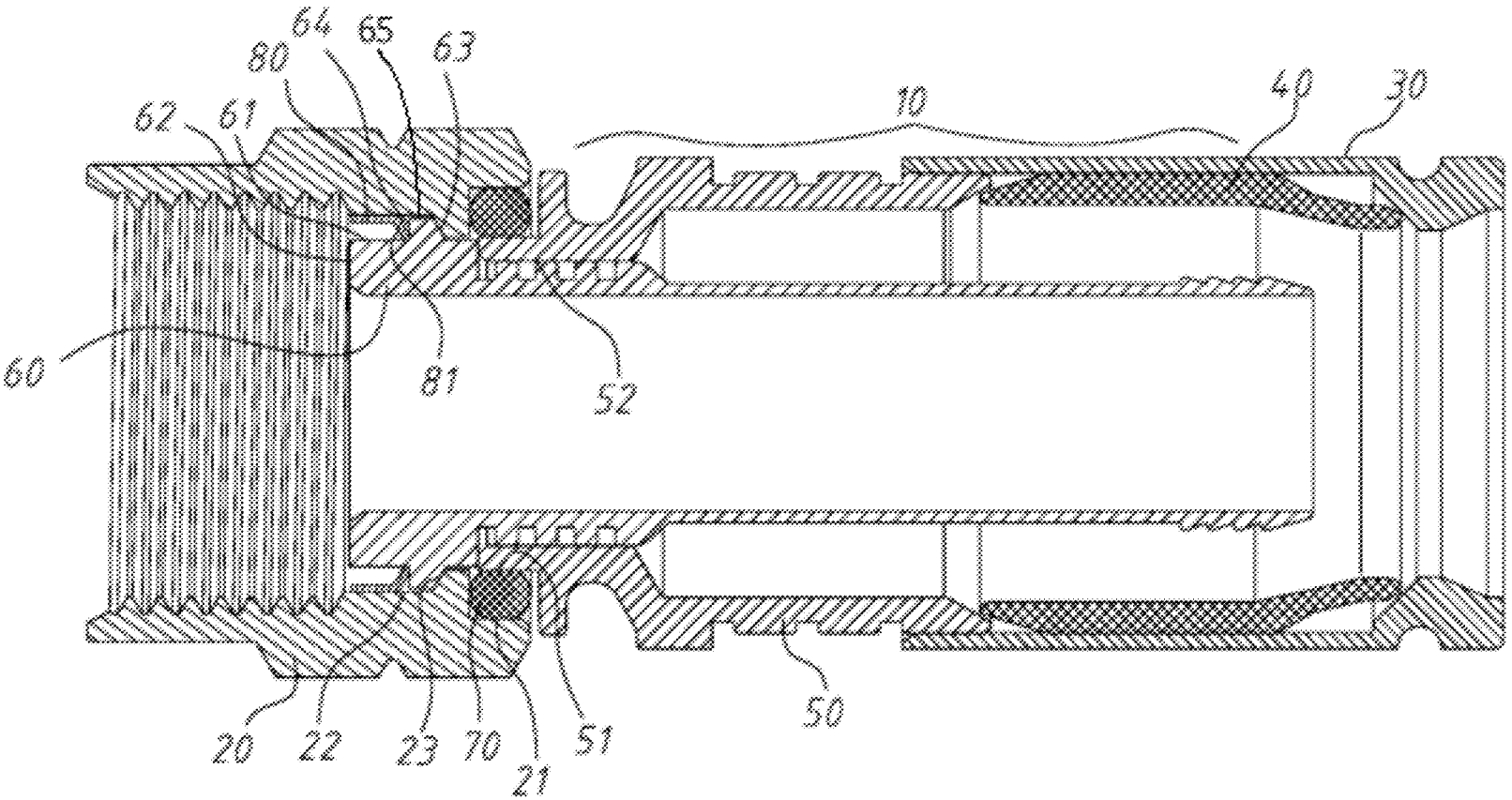
FIG. 5 depicts a sectional view of an embodiment of the coaxial cable.

Referring to FIG. 5, the coupling member 20 has a first end that is proximate and rotatable with respect to said connector body 10 at said second end of said connector body 10 and a second end configured to interface with a mating device 92 or F-connector 95. The coupling member 20 includes an internal lip, such as an internal annular protrusion, located proximate the rearward end of the coupling member 20, having a forward facing surface 23. The forward facing surface 23 of the internal lip may be a tapered or angled surface generally facing the forward end of the coupling member 20. The coupling member 20 includes an internal surface 22 that is annularly disposed between the forward facing surface 23 of the internal lip and the internal threading 94 of the coupling member 20. The configuration of the internal surface 22 may vary to accommodate different functionality and configurations of the grounding member 80. The internal surface 22 may further include structures such as ridges, grooves, curves, detents, slots, openings, chamfers, or other structural features, etc., which may facilitate placement of said grounding member 80. The coupling member 20 includes an internal ledge 21 that is annularly displaced proximate the rearward end of the coupling member 20. The internal ledge 21 forms a collar. The internal ledge 21 generally faces the axial center of coupling member 20. The configuration of the internal ledge 21 may vary according to different parameters to accommodate different functionality of a coaxial cable connector 91 or O-ring 70 configuration. For instance, the internal ledge 21 may abut at a right angle the body of coupling member 20 or may taper or slope at constant or varying angles from the internal lip to the rearward end of the coupling member 20. The internal ledge 21 may further include structures such as ridges, grooves, curves, detents, slots, openings, chamfers, or other structural features, etc., which may facilitate placement of said O-ring 70. Moreover, the rearward end the coupling member 20 may extend a significant axial distance to reside radially extent, or otherwise partially surround, a portion of the connector body 10, although the extended portion of the coupling member 20 need not contact the connector body 10. Moreover, the coupling member 20 may contact a tubular clamping body 50, although the coupling member 20 need not contact the tubular clamping body 50. The structural configuration of the coupling member 20 may vary according to differing connector parameters to accommodate different functionality of a coaxial cable connector. For instance, the forward end of the coupling member 20 may include internal and/or external structures such as ridges, grooves, curves, detents, slots, openings, chamfers, or other structural features, etc., which may facilitate the operable joining of an environmental sealing member, such a water-tight seal or other attachable component element, that may help prevent ingress of environmental contaminants, such as moisture, oils, and dirt, when mated with the mating device 92 or F-connector 95. Those in the art should appreciate that the coupling member 20 need not be threaded. Moreover, the coupling member 20 may have features commonly used in connecting RCA-type, or BNC-type connectors, or other common coaxial cable connectors having standard coupler interfaces. The coupling member 20 may be formed of conductive materials, such as copper, brass, aluminum, or other metals or metal alloys, facilitating grounding through the coupling member 20. Accordingly, the coupling member 20 may be configured to extend an electromagnetic buffer by electrically contacting conductive surfaces of a mating device 92 or F-connector 95 when a coaxial cable connector 91 is moved into contact with the mating device 92 or F-connector 95. In addition, the coupling member 20 may be formed of both conductive and non-conductive materials. For example the external surface of the coupling member 20 may be formed of a polymer, while the remainder of the coupling member 20 may be comprised of a metal or other conductive material. The coupling member 20 may be formed of metals or polymers or other materials that would facilitate a rigidly formed coupling body. Manufacture of the coupling member 20 may include casting, extruding, cutting, knurling, turning, tapping, drilling, injection molding, blow molding, combinations thereof, or other fabrication methods that may provide efficient production of the component.

Referring to FIGS. 4-7, an embodiment of a coaxial cable connector 91 may include a post 60. When operationally installed, the post 60 is axially disposed inside of the coupling member 20 and connector body 50. The post 60 comprises a forward end having a forward end face 62 and an opposing rearward end having a barbed engagement portion. The forward end face 62 of post 60 may be configured to make physical and electrical contact with a corresponding contact face 903 of the F-connector 95 or mating device 92 (as shown in exemplary fashion in FIG. 7). Furthermore, the post 60 may comprise a post collar 65, such as an annular protrusion, disposed proximally to the forward end face 62 of external surface of post 60. The post collar 65 includes a forward facing surface 64 that generally faces the forward end face 62 of post 60. The post 60 may comprise a post neck 61, such as an annular ledge, that is axially disposed between the forward facing surface 64 and the forward end face 62. The configuration of the post neck 61 may vary to accommodate different functionality and configurations of the grounding member 80. The post neck 61 may further include structures such as ridges, grooves, curves, detents, slots, openings, chamfers, or other structural features, etc., which may facilitate placement of said grounding member 80. For instance, the post neck 61 may abut at a right angle the forward facing surface 64 and/or the forward end face 62 of the post 60, or may slope at constant or varying angles between the forward facing surface 64 and/or the forward end face 62. The structural configuration of the post neck 61 may vary according to differing grounding member 80 design parameters to accommodate different functionality and manufacture of a coaxial cable connector 91. The post collar 65 of the post 60, includes a rearward facing surface 63 that contacts the forward facing surface 23 of the coupling member 20, when operably assembled in a coaxial cable connector 91, so as to allow the coupling member 20 to rotate with respect to the other component elements, such as the post 60 and the connector body 10, of the coaxial cable connector 91. Furthermore, the rearward facing surface 63 may contact the forward facing surface 23 of the coupling member 20, so as to provide a grounding path between the post 60 and coupling member 20, when operably assembled in a coaxial cable connector 91. The rearward facing surface 63 of the post collar 65 may be a tapered or sloped surface generally facing the rearward end of the post 60. The post collar 65 of post 60 may include a annular surface axially defined between the forward facing surface 64 and the rearward facing surface 63, that may contact the internal surface 22 of the coupling member 20 thereby providing a grounding path between the post 60 and coupling member 20 when operationally assembled. An embodiment of the post 60 need not include such a feature and the annular surface of the post collar 65 need not contact the internal surface 22 of the coupling member 20 (as shown in exemplarily fashion in FIGS. 6 & 6A). Further still, another embodiment of the post 60 may include a surface feature such as a lip or protrusion that may engage a portion of a tubular clamping body 50 to secure axial movement of the post 60 relative to the connector body 10. The location proximate or near where the connector body 10 is secured relative to the post 60 may include surface features, such as ridges, grooves, protrusions, or knurling, which may enhance the secure attachment and locating of the post 60 with respect to the connector body 10. The tubular clamping body 50 may also include a post mounting portion 52 capable of securing the post into operational position. However, the post 60 and/or the tubular clamping body 50 need not include such a surface feature, and the coaxial cable connector may rely on press-fitting, friction-fitting forces, and/or other component structures having features and geometries to help retain the post 60 in secure location both axially and rotationally relative to the connector body 10.

Figure 6:
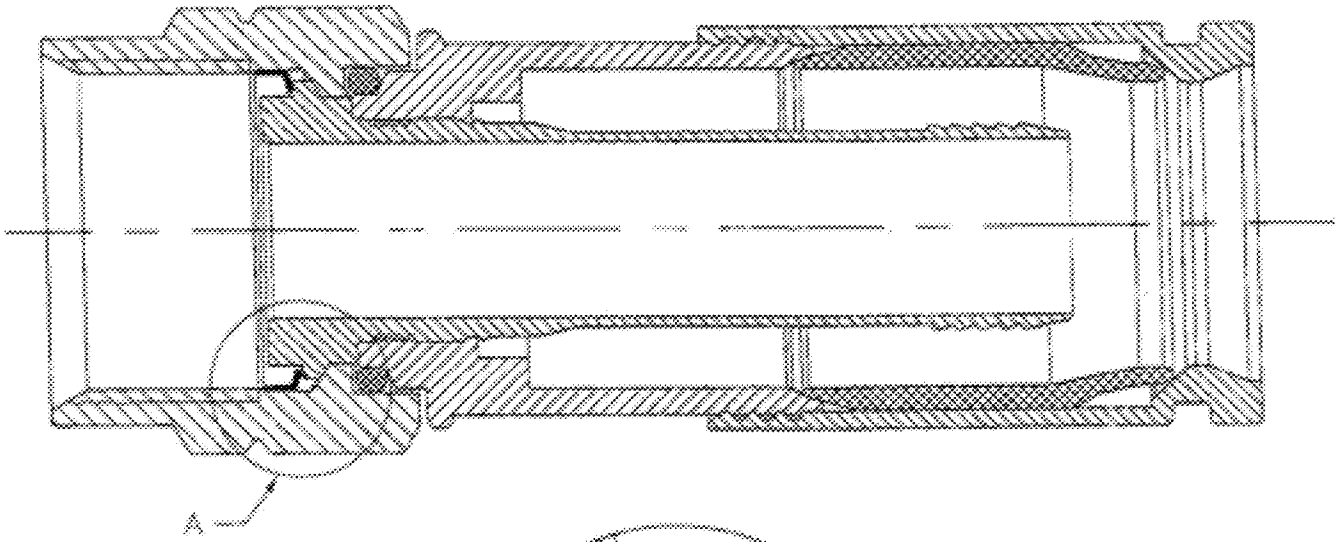
FIG. 6 depicts a sectional view of another embodiment of the coaxial cable connector.
Figure 7:
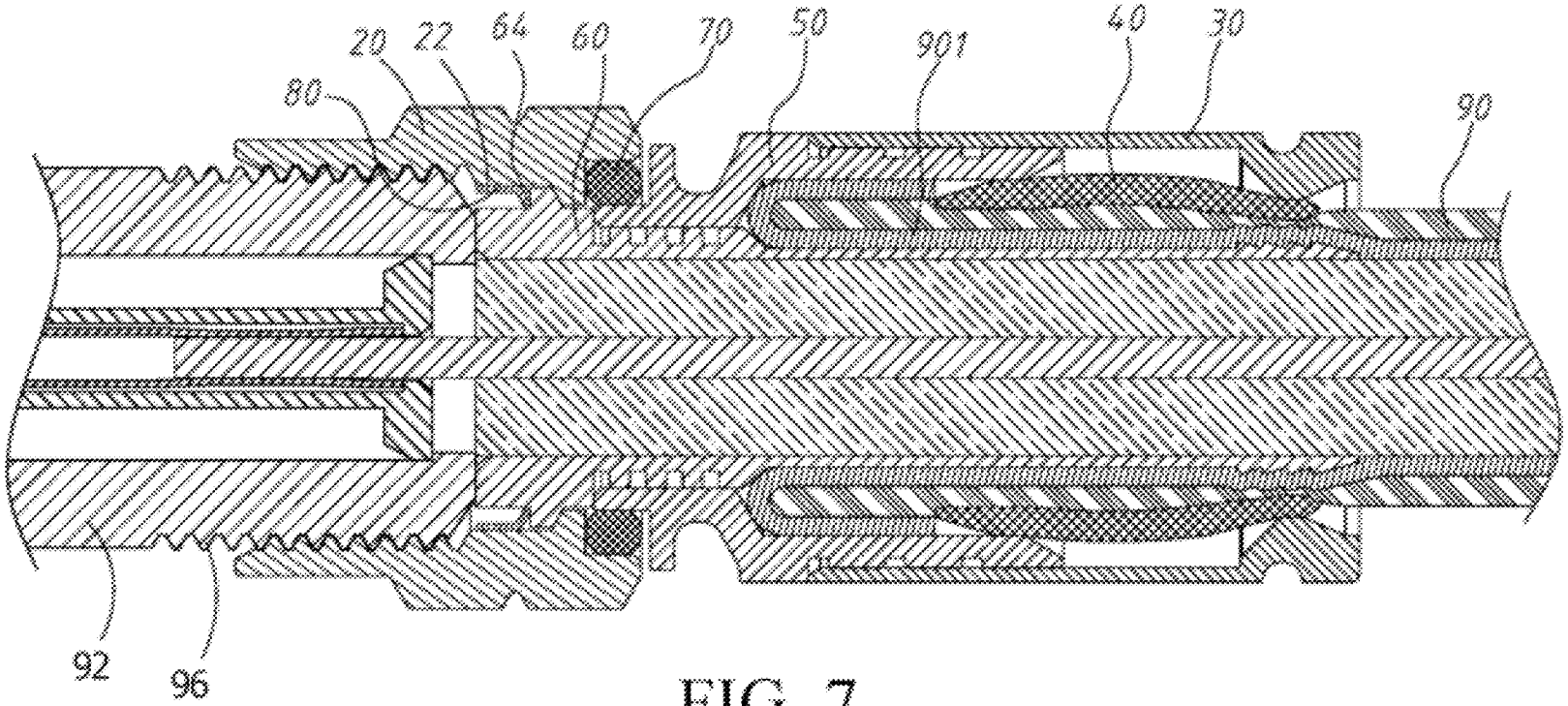
FIG. 7 depicts a perspective view of the embodiment of the coaxial cable connector, wherein a coaxial cable and mating device are attached to the connector.

Referring to FIGS. 4-7, the post 60 should be dimensioned, or otherwise sized, such that the post 60 may be inserted into an end of the prepared coaxial cable 90, around the dielectric and under the conductive shield 901 (example shown in FIG. 7). The post 60 may have barbed engagement portion extending around the periphery thereof remote from the post neck 61. Accordingly, where an embodiment of the post 60 may be inserted into an end of the prepared coaxial cable 90 under the drawn back conductive shield 901, substantial physical and/or electrical contact with the conductive shield 901 may be accomplished thereby facilitating grounding through the post 60. The post 60 should be conductive and may be formed of metals or may be formed of other conductive materials that would facilitate a rigidly formed post body. In addition, the post 60 may be formed of a combination of both conductive and non-conductive materials. For example, a metal coating or layer may be applied to a polymer of other non-conductive material. Manufacture of the post 60 may include casting, extruding, cutting, turning, drilling, knurling, injection molding, spraying, blow molding, component overmolding, combinations thereof, or other fabrication methods that may provide efficient production of the component.

Figure 6A:
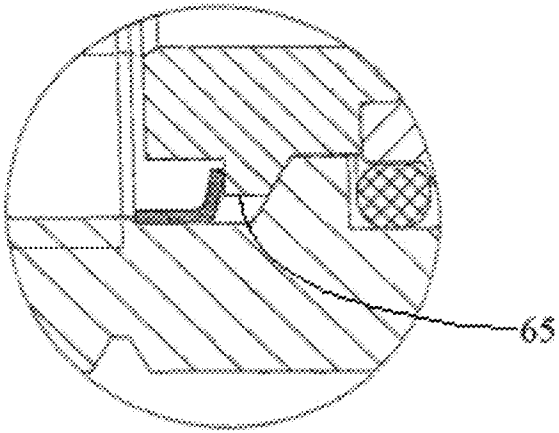
FIG. 6A is an enlarged view of the an embodiment of he grounding member of the coaxial cable connector of FIG. 6.

Referring to FIGS. 4-7, an embodiment of the coaxial cable connector 91 may include a grounding member 80. The grounding member 80 is conductive. Furthermore, embodiments of a grounding member 80 may exhibit resiliency. The grounding member 80 may be disposed axially forward of the forward facing surface 64 of post 60 when operationally assembled. Furthermore, the grounding member 80 may be disposed between the post neck 61 and the internal surface 22 of the coupling member 20. The grounding member 80 may contact the internal surface 22 of the coupling member 20 and the post neck 61 and/or the forward facing surface 64 of post 60 when operationally assembled providing a grounding path between the coupling member 20 and the post 60. As depicted in FIG. 6 and FIG. 6A in detail, the grounding member 80 may contact the forward facing surface 64 of post 60 and not simultaneously contact the post neck 61. Another embodiment, as shown in FIGS. 5 & 7, the grounding member 80 may contact the post neck 61, the forward facing surface 64 of post 60, or both simultaneously to provide a grounding pathway between the coupling member 20 and the post 60 when operationally assembled. The grounding member 80 may have a post contact portion or post contact portions 81 (as shown in exemplary fashion in FIG. 4A). The post contact portion 81 of the grounding member 80 are depicted as resilient members, such as flexible fingers, that extend to resiliently engage the post 60. This resiliency of the post contact portion 81 may facilitate enhanced contact with the post 60 when the coupling member 20 moves during operation of the coaxial cable connector 91, because the post contact portion 81 may flex and retain constant physical and electrical contact with the post 60 and coupling member 20, thereby ensuring continuity of a grounding path extending through the coupling member 20, grounding member 80, and post 60. Another embodiment, not depicted but easily comprehensible by those skilled in the requisite art, may axially invert the grounding member 80 so that the post contact portion 81 contact the internal surface 22 of the coupling member 20. As depicted, the grounding member 80 may be deformably compressed or press-fit onto the post 60, so that the post contact portion 81 of the grounding member 80 are axially and/or rotationally secured to the post 60. The grounding member 80 may be operationally deformably compressed or pressed into position by the contact face 903 of the F-connector 95 or mating device 92 (as shown in exemplary fashion in FIG. 5). Another embodiment of the coaxial cable connector 91 (not shown, but readily comprehensible by those of ordinary skill in the art), a grounding member 80 may be operationally installed between the post neck 61 and the internal surface 22 of the coupling member 20, and retain constant physical and electrical contact with the post 60 and coupling member 20, due to the resiliency of the grounding member 80 and not rely on the contact face 903 of the F-connector 95 or mating device 92 to be placed in operational position. Although the grounding member 80 is shown in FIG. 4-7 as an annular ring, it may have various shapes and sizes, for example the grounding member 80 may extend axially forward of or around the forward end face 62 of the post 60. The grounding member 80 may also include ridges, notches, protrusions, knurling, or other friction or gripping type arrangements. The grounding member 80 may be formed of conductive materials, such as copper, brass, aluminum, steel or other metals or metal alloys, facilitating grounding through the grounding member 80. In addition, the grounding member 80 may be formed of both conductive and non-conductive materials. For example the external surface of the grounding member 80 may be formed of a conductive material, while the remainder of the grounding member 80 may be comprised of a non-conductive material. The grounding member 80 may be formed of metals or polymers or other materials that would facilitate a resilient structure providing a grounding path between the post 60 and coupling member 20. Manufacture of the grounding member 80 may include casting, extruding, cutting, knurling, turning, tapping, drilling, injection molding, blow molding, combinations thereof, or other fabrication methods that may provide efficient production of the component. Embodiments of a grounding member 80 may be formed, shaped, fashioned, or otherwise manufactured via any operable process that will render a workable component, wherein the manufacturing processes utilized to make the continuity member may vary depending on the structural configuration of the grounding member 80. For example, a grounding member 80 having post contact portion 81 may be formed from a sheet of material that may be stamped and then bent into an operable shape, that allows the grounding member 80 to function as it was intended. Those in the art should appreciate that various other features may be provided on the grounding member 80 through stamping or by other manufacturing and shaping means. Accordingly, it is contemplated that features of the grounding member 80 may be provided to mechanically interlock or interleave, or otherwise operably physically engage complimentary and corresponding features of embodiments of a coupling member 20 and/or complimentary and corresponding features of embodiments of a post 60.

Referring to FIGS. 4-7, embodiments of a coaxial cable connector 91 may include a connector body 10. The connector body 10 may comprise a first end capable of receiving the prepared end of the coaxial cable 90 and opposing second end. Said first end may include a fastener member 30, a bushing 40, and tubular clamping body 50. The elements of the connector body 10, specifically the fastener member 30, a bushing 40, or tubular clamping body 50, may be formed of conductive or non-conductive materials or a combination thereof. Further, the elements of the connector body 10 may be formed from materials such as plastics, polymers, bendable metals or composite materials that facilitate a rigid or semi-rigid form for the operational joining of said elements. Manufacture of the connector body 10 may include casting, extruding, cutting, turning, drilling, knurling, injection molding, spraying, blow molding, component overmolding, combinations thereof, or other fabrication methods that may provide efficient production of the component and/or components.

With further reference to FIGS. 4-7, embodiments of a connector body 10 may include a fastener member 30. The fastener member 30 may have a first fastener end capable of receiving the prepared end of the coaxial cable 90 and opposing second end. The fastener member 30 may comprise a central passageway defined between the first end and second end and extending axially through the fastener member 30. In addition, the fastener member 30 may include an inner surface feature such as a lip or protrusion that may engage a portion of the tubular clamping body 50 to secure movement of the fastener member 30 relative to the connector body 10. The location proximate or near where the fastener member 30 is secured relative to the tubular clamping body 50 may include surface features, such as ridges, grooves, protrusions, or knurling, which may enhance the secure attachment and locating of the fastener member 30 with respect to the connector body 10. The tubular clamping body 50 may include a corresponding portion capable of securing the fastener member 30 into operational position. However, the fastener member 30 and/or the tubular clamping body 50 need not include such a surface feature, and the coaxial cable connector 91 may rely on press-fitting and friction-fitting forces and/or other component structures having features and geometries to help retain the fastener member 30 in secure location both axially and rotationally relative to the connector body 10. Moreover, the fastener member 30 may include a surface feature such as an internal annular lip or protrusion that may engage a portion of the bushing 40 to operably engage the bushing 40 on the prepared coaxial cable 90. Additionally, the fastener member 30 may comprise an exterior surface feature positioned proximate with or close to the first end of the fastener member 30. The surface feature may facilitate gripping of the fastener member 30 during operation of the coaxial cable connector 91. Although the surface feature is shown in FIG. 4 as an annular detent, it may have various shapes and sizes such as a ridge, notch, protrusion, knurling, or other friction or gripping type arrangements. It should be recognized, by those skilled in the requisite art, that the fastener member 30 may be formed of rigid materials such as metals, hard plastics, polymers, composites and the like, or combinations thereof. Furthermore, the fastener member 30 may be manufactured via casting, extruding, cutting, turning, drilling, knurling, injection molding, spraying, blow molding, component overmolding, combinations thereof, or other fabrication methods that may provide efficient production of the component. The fastener member 30 may be formed of conductive or non-conductive materials or combinations conductive and non-conductive materials.

With further reference to FIG. 4-7, embodiments of a connector body 10 may include a bushing 40. The bushing 40 may have a first bushing end capable of receiving the prepared end of the coaxial cable 90 and opposing second end. The bushing 40 may comprise a central passageway defined between the first end and second end and extending axially through the bushing 40. The central passageway may comprise a ramped surface which may be positioned between a first opening or first bore having a first diameter positioned proximate with the first end of the bushing 40 and a second opening or second bore having a second diameter positioned proximate with the second bushing end of the bushing 40. The ramped surface may act to deformably compress the outer surface of a coaxial cable 90 when the fastener member 30 is operated to secure a coaxial cable 90. For example, the narrowing geometry may compress/squeeze the bushing 40 against the cable, when the fastener member 30 is compressed into a tight and secured position on the connector body. Although the external first and second ends of the bushing 40 are shown in FIG. 4 to have annular features, the first and second bushing ends of the bushing 40 may have various shapes and sizes such as a ridge, notch, protrusion, knurling, friction, gripping, or ramp type arrangements. It should be recognized, by those skilled in the requisite art, that the bushing 40 may be formed of rigid or semi-rigid materials such as metals, hard plastics, polymers, composites and the like, and/or combinations thereof. Furthermore, the bushing 40 may be manufactured via casting, extruding, cutting, turning, drilling, knurling, injection molding, spraying, blow molding, component overmolding, combinations thereof, or other fabrication methods that may provide efficient production of the component. The bushing 40 may be formed of conductive or non-conductive materials or combinations conductive and non-conductive materials.

With further reference to FIG. 4-7, embodiments of a connector body 10 may include a tubular clamping body 50. The tubular clamping body 50 may have a first end capable of receiving the prepared end of the coaxial cable 90 and opposing second end proximate the coupling member 20. The second end of the tubular clamping body 50 may include the post mounting portion 52 annularly disposed on the internal surface of the tubular clamping body 50. Although the post mounting portion 52 are shown in FIGS. 4 and 7 to have annular features, the post mounting portion 52 may have various shapes and sizes such as a ridge, notch, protrusion, knurling, friction, gripping, or ramp type arrangements. However, the post mounting portion 52 need not include such a surface feature, and the coaxial cable connector 91 may rely on press-fitting and friction-fitting forces and/or other component structures having features and geometries to help retain the post 60 in secure location both axially and rotationally relative to the connector body 10. The second end of the tubular clamping body 50 may also include a neck 51, such as an external annular ledge. The neck 51 of the tubular clamping body 50 may generally face the away from the axial center of the tubular clamping body 50. The neck 51 may be generally axially opposed from the internal ledge 21 of the coupling member 20. The configuration of the neck 51 may vary to accommodate different functionality of a coaxial cable connector 91 or O-ring 70 configuration. For instance, the neck 51 may abut at a right angle to the body of the tubular clamping body 50 or may taper or slope at constant or varying angles away from or towards the second end of the tubular clamping body 50. The neck 51 may further include structures such as ridges, grooves, curves, detents, slots, openings, chamfers, or other structural features, etc., which may facilitate placement of the O-ring 70. It should be recognized, by those skilled in the requisite art, that the tubular clamping body 50 may or may not contact coupling member 20 when operationally engaged. It should further be recognized, by those skilled in the requisite art, that the tubular clamping body 50 may be formed of rigid or semi-rigid materials such as metals, hard plastics, polymers, composites and the like, or combinations thereof. Furthermore, the tubular clamping body 50 may be manufactured via casting, extruding, cutting, turning, drilling, knurling, injection molding, spraying, blow molding, component overmolding, combinations thereof, or other fabrication methods that may provide efficient production of the component. The tubular clamping body 50 may be formed of conductive or non-conductive materials or combinations of conductive and non-conductive materials.

Thus the reader will see that at least one embodiment of the present invention provides a more reliable coaxial cable connector, provides multiple grounding paths even in the event of improper installation, protects delicate parts such as the grounding member from damage due to exposure to the environment or corrosive factors, allows for the use of non-conductive or combinations of conductive and non-conductive materials in the manufacture of the connector body thereby allowing for greater operational utility, economical production, allows for installation of the grounding member by means of operationally installing the coaxial cable connector to the mating device or by press fitting prior to operational installation, allows for lightweight design of the coaxial cable connector, and can be installed by professionals and laypersons alike.

While the above description contains many specificities, these should not be construed as limitations on the scope, but rather as an exemplification of one preferred embodiment thereof. Many other variations are possible. For example, the grounding member may have a continuous annular resilient post contact portion. By way of another example, embodiments of the coaxial cable connector may be configured or resized to facilitate use with various sizes of coaxial cables. Accordingly, the scope should be determined not by the embodiment(s) illustrated, but by the appended claims and their legal equivalents.

What is claimed is:

1. An electrical connector, comprising:

a connector body having opposite first and second ends, said first end being configured to receive a prepared end of a cable;

a coupling member having a first end that is proximate to said second end of said connector body and a second end configured to interface with a mating device;

a post having a forward end and a rearward end, the forward end including an post collar having a forward facing surface and a rearward facing surface, wherein the rearward end of the post is configured to contact at least a portion of the conductive shield of the coaxial cable when the cable is attached to the connector; and a grounding member disposed axially forward of the forward facing surface of said post collar;

whereby said grounding member, said coupling member and said post creates at least one grounding path.

2. An electrical connector according to claim 1, wherein said connector body is non-conductive.

3. An electrical connector according to claim 1, wherein said grounding member is resilient.

4. An electrical connector according to claim 1, wherein said grounding member includes a resilient post contact portion.

5. An electrical connector, comprising:

a connector body having opposite first and second ends, said first end being configured to be coupled with a prepared end of a cable;

a coupling member comprising a first first end that is proximate to said second end of said connector body, a second end configured to interface with a mating device, a internal lip having a forward facing surface that is annularly displaced proximate said first end of said coupling member, an internal surface annularly defined between said forward facing surface of said internal lip and said second end of said coupling member;

a post axially disposed inside of said coupling member and said connector body comprising a forward end and a rearward end, the forward end including a post collar having a forward facing surface and a rearward facing surface, a forward end face disposed at the forward end of said post, a post neck disposed axially between said forward facing surface of the post collar and said forward end face of said post; and a grounding member disposed axially forward of said forward facing surface of said post;

whereby said grounding member, said coupling member and said post creates at least one grounding path.

6. An electrical connector according to claim 5, wherein said connector body is non-conductive.

7. An electrical connector according to claim 5, wherein said grounding member is resilient.

8. An electrical connector according to claim 5, wherein said grounding member includes a resilient post contact portion.

9. An electrical connector according to claim 5, wherein said forward facing surface of said internal lip of said coupling member contacts said rearward facing surface of said post collar thereby providing a grounding pathway between said coupling member and said post.

10. An electrical connector according to claim 5, wherein said grounding member contacts said internal surface of said coupling member and said post thereby providing a grounding pathway between said coupling member and said post.

11. An electrical connector according to claim 5, wherein said forward facing surface and said rearward facing surface of said said post collar of said post define a annular surface that contacts said internal surface of said coupling member thereby providing a grounding pathway between said coupling member and said post.

12. A method of assembling an electrical connector for a coaxial cable having a conductive shield, the method comprising:

providing a post having a forward end and a rearward end, the forward end including an post collar having a forward facing surface and a rearward facing surface, wherein the rearward end of the post is configured to contact at least a portion of the conductive shield of the coaxial cable when the cable is attached to the electrical connector;

positioning a portion of the post within a portion of a connector body;

positioning a coupling member on the post, said coupling member being axially rotatable with respect to the post and the connector body, the coupling member having a second end configured to interface with a mating device, an opposing first end, an internal lip having a forward facing surface that is annularly displaced proximate said first end of said coupling member, an internal surface annularly defined between said forward facing surface of said internal lip and said second end of said coupling member; and positioning a grounding member axially forward of said forward facing surface of said post collar of said post;

whereby said grounding member, said coupling member and said post creates at least one grounding path.

13. The method of claim 12, further comprising the step of installing said grounding member wherein said grounding member is operationally installed on said post by coupling said coupling member to a mating device.

14. The method of claim 12, providing a resilient grounding member having a post contact portion thereby facilitating enhanced contact with said post and said coupling member.

15. The method of claim 12, positioning a resilient grounding member between and in contact with the post and the coupling member thereby enhancing contact therebetween.

* * * * *